US007688073B2

(12) United States Patent
Shimazaki et al.

(10) Patent No.: US 7,688,073 B2
(45) Date of Patent: Mar. 30, 2010

(54) DIAGNOSIS DEVICE OF CAPACITOR DISCHARGE IGNITION DEVICE FOR ENGINE

(75) Inventors: Mitsuyoshi Shimazaki, Numazu (JP); Jun Kawagoe, Numazu (JP)

(73) Assignee: Kokusan Denki Co., Ltd., Shizuoka (JP)

( * ) Notice: Subject to any disclaimer, the term of this patent is extended or adjusted under 35 U.S.C. 154(b) by 273 days.

(21) Appl. No.: 12/026,566

(22) Filed: Feb. 6, 2008

(65) Prior Publication Data

US 2008/0191700 A1 Aug. 14, 2008

(30) Foreign Application Priority Data

Feb. 8, 2007 (JP) ..... 2007-029470

(51) Int. Cl.
*F02P 17/00* (2006.01)

(52) U.S. Cl. ..... 324/382; 324/380

(58) Field of Classification Search ..... 324/380, 324/382

See application file for complete search history.

(56) References Cited

U.S. PATENT DOCUMENTS 6,492,818 B1 * 12/2002 Downs ..... 324/382

FOREIGN PATENT DOCUMENTS

JP 60-41581 3/1985
JP 8-135548 A 5/1996

* cited by examiner

*Primary Examiner*—Vincent Q Nguyen
(74) *Attorney, Agent, or Firm*—Pearne & Gordon LLP

(57) ABSTRACT

A diagnosis device of a capacitor discharge ignition device for an engine that detects, as a singularity, a leading edge or a trailing edge of a voltage between output terminals of an ignition power supply portion that generates a voltage for charging an ignition capacitor, counts the number of singularities detected while a crankshaft rotates through a measurement section, which is a section of a certain crank angle determined with reference to a pulse signal obtained by a signal generator that generates a pulse signal at a specific crank angle position of an engine, and diagnoses an abnormality of the ignition device and a cause of the abnormality by comparing the count value of singularity with the number of times of normal ignition of the engine performed while the crankshaft rotates through the measurement section.

11 Claims, 8 Drawing Sheets

Fig. 1
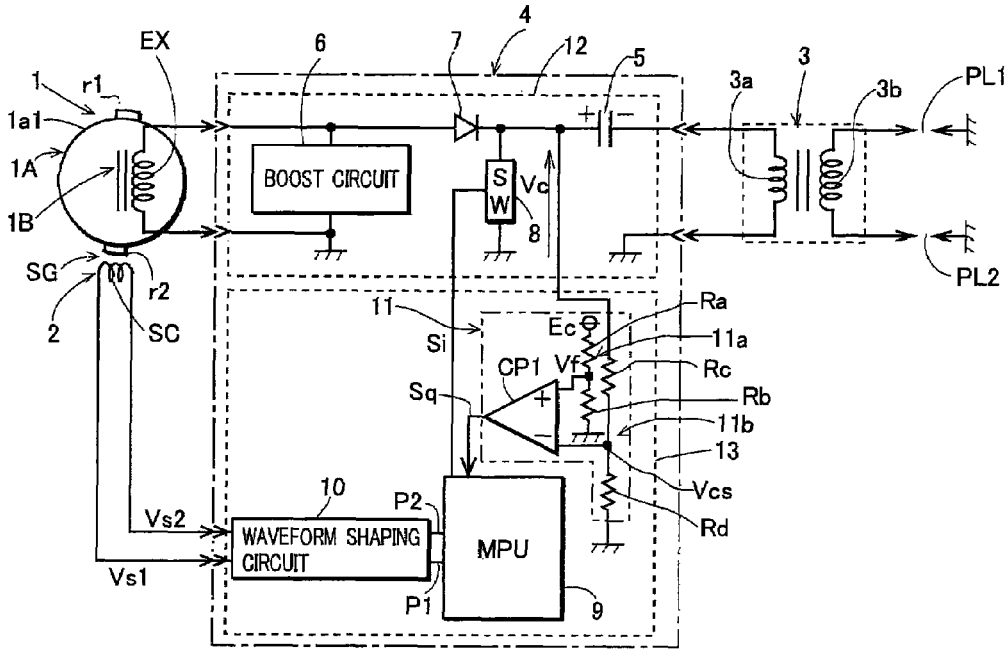
Fig. 3A
Fig. 3B
Fig. 3C
Fig. 3D
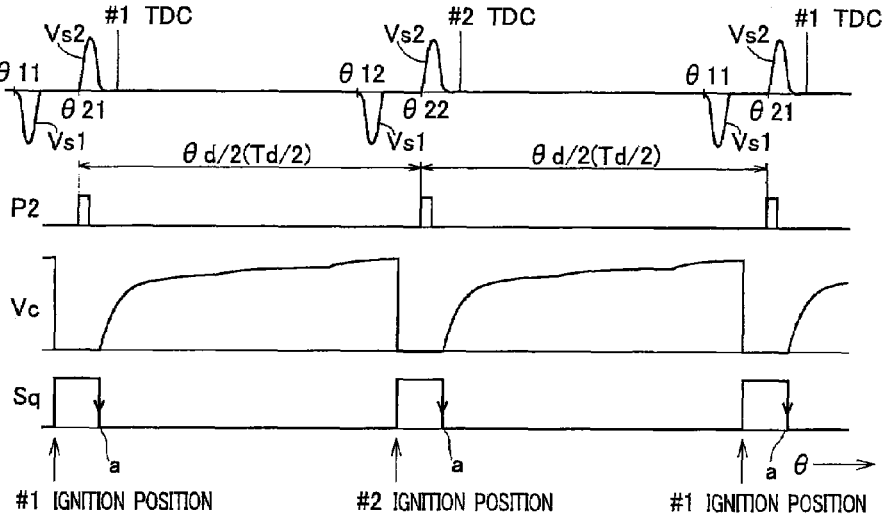

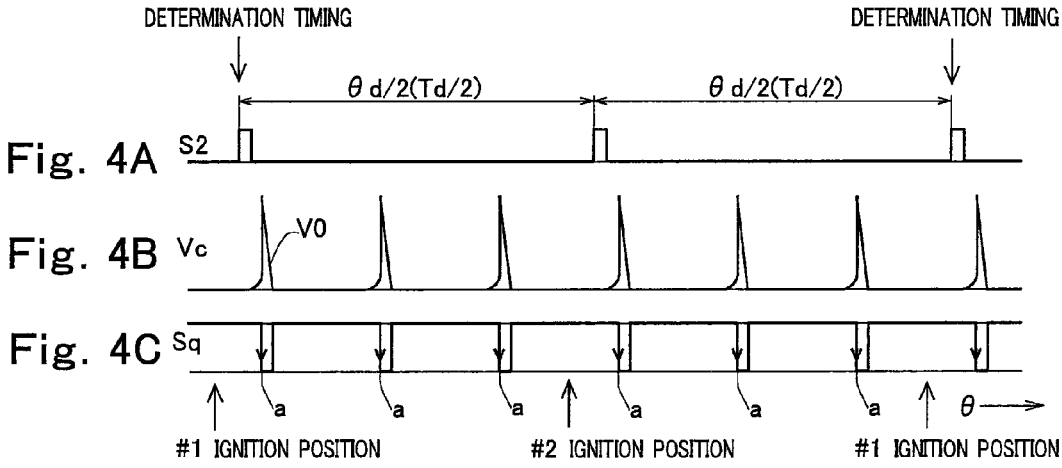
DETERMINATION TIMING
DETERMINATION TIMING
θ d/2(Td/2)
θ d/2(Td/2)
Fig. 4A
S2
Fig. 4B
Vc
V0
Fig. 4C
Sq
a
a
a
a
a
a
θ
#1 IGNITION POSITION
#2 IGNITION POSITION
#1 IGNITION POSITION
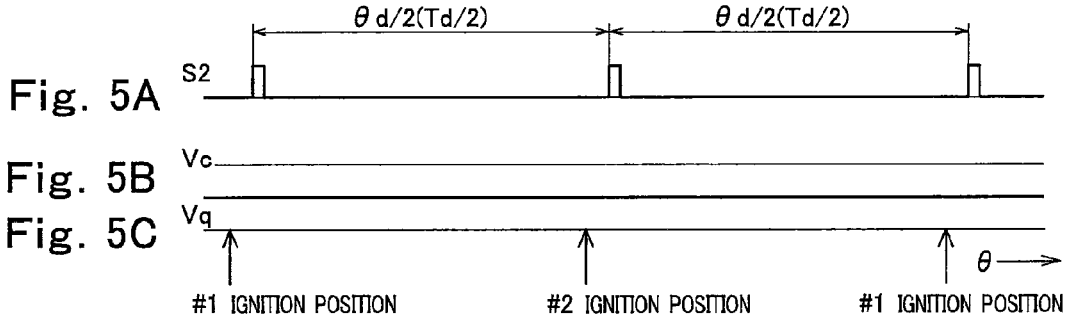
θ d/2(Td/2)
θ d/2(Td/2)
Fig. 5A
S2
Fig. 5B
Vc
Fig. 5C
Vq
θ
#1 IGNITION POSITION
#2 IGNITION POSITION
#1 IGNITION POSITION B:The number of times of ignition performed during determination time period
C:The number of times of generation of capacitor charging voltage during determination time period

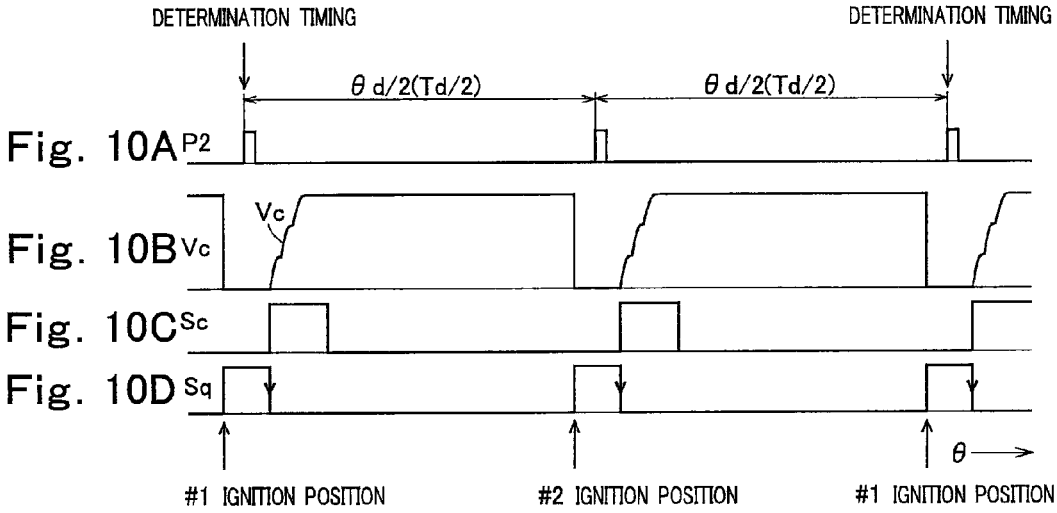
DETERMINATION TIMING
DETERMINATION TIMING
θ d/2(Td/2)
θ d/2(Td/2)
Fig. 10A P2
Fig. 10B Vc
Vc
Fig. 10C Sc
Fig. 10D Sq
θ
#1 IGNITION POSITION
#2 IGNITION POSITION
#1 IGNITION POSITION
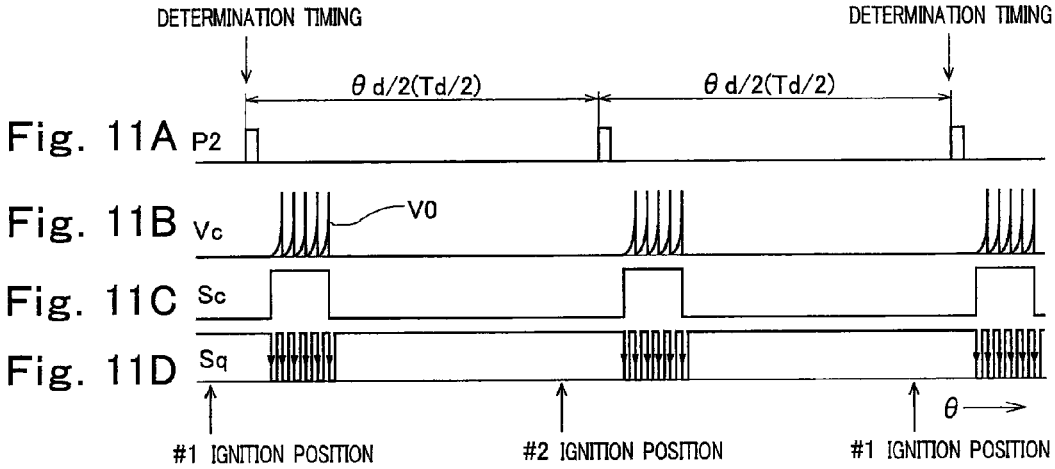
DETERMINATION TIMING
DETERMINATION TIMING
θ d/2(Td/2)
θ d/2(Td/2)
Fig. 11A P2
Fig. 11B Vc
V0
Fig. 11C Sc
Fig. 11D Sq
θ
#1 IGNITION POSITION
#2 IGNITION POSITION
#1 IGNITION POSITION

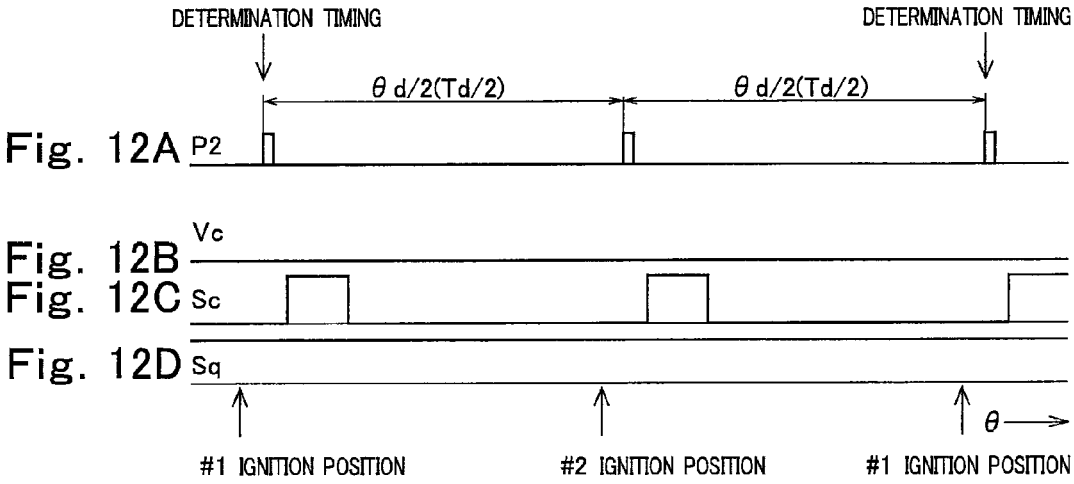
Fig. 13
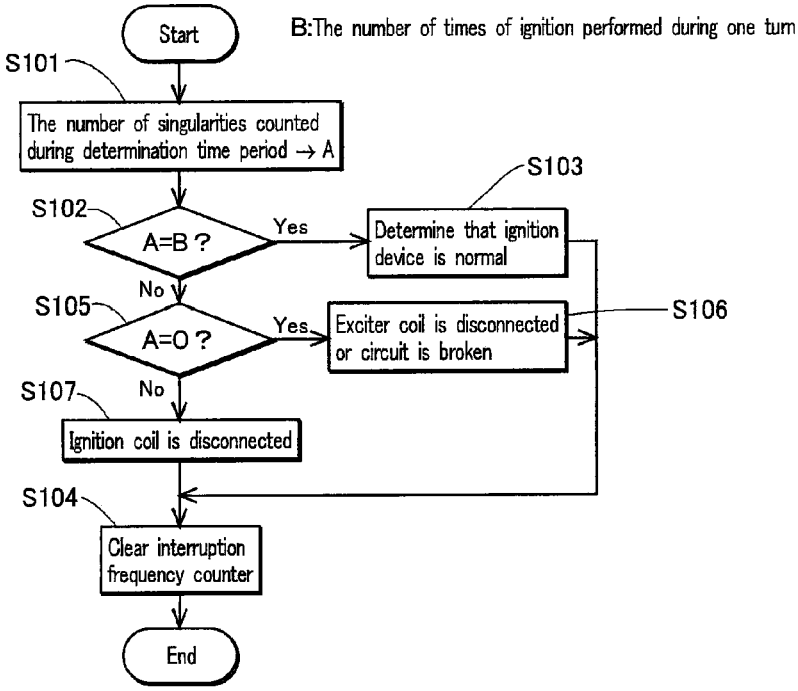

DIAGNOSIS DEVICE OF CAPACITOR DISCHARGE IGNITION DEVICE FOR ENGINE

TECHNICAL FIELD OF THE INVENTION

The present invention relates to a diagnosis device that diagnoses an abnormality of a capacitor discharge ignition device for an engine and a cause of the abnormality.

PRIOR ART OF THE INVENTION

An engine control device that controls electrical components such as an ignition device or a fuel injection device using a microprocessor desirably has a diagnosis function (self diagnosis function) so as to store history of abnormalities that occur in the electrical components and causes of the abnormalities for proper maintenance or repair of the engine.

To provide the control device with the self diagnosis function, information on operation states of the electrical components needs to be provided to a microprocessor so as to determine whether there is an abnormality. When it is detected that there is an abnormality in any of the electrical components, it is desirable that a cause of the abnormality can be specified.

The present invention is directed to a diagnosis device used for diagnosing a capacitor discharge ignition device among various electrical components mounted to an engine. Various types of capacitor discharge ignition devices are known. Among the various types of capacitor discharge ignition devices, the present invention is directed to a capacitor discharge ignition device comprising: an ignition power supply portion that repeatedly outputs a capacitor charging voltage of a pulse waveform with a peak value of two hundred and several ten volts between output terminals; an ignition coil; an ignition circuit connected in series with a primary coil of the ignition coil and including an ignition capacitor connected between the output terminals of the ignition power supply portion through the primary coil, and a discharge switch that conducts when receiving an ignition signal and discharges charges accumulated in the ignition capacitor through the primary coil of the ignition coil; and an ignition position control portion that provides the ignition signal to the discharge switch at an ignition position of the engine.

The ignition power supply portion includes one comprised of an exciter coil provided in an AC generator driven by an engine and a rectifier circuit that rectifies an AC output of the exciter coil, or a DC converter for increasing an output voltage of a battery. As disclosed in Japanese Utility Model Application Laid-Open Publication No. 60-41581, a boost circuit is sometimes used as the ignition power supply portion, which passes a short-circuit current through an exciter coil in a half wave having one polarity of an output of the exciter coil provided in an AC generator driven by an engine, and interrupts the short-circuit current to induce an increased voltage of a pulse waveform in the exciter coil when the short-circuit current becomes a set value or more.

A known method for diagnosing an abnormality of such a capacitor discharge ignition device for an engine is disclosed in Japanese Patent Application Laid-Open Publication No. 8-135548. In the diagnosis method described in Japanese Patent Application Laid-Open Publication No. 8-135548, a charging voltage of an ignition capacitor at the time when a predetermined time has elapsed from a charging start time of an ignition capacitor is monitored, and it is determined that the ignition device is abnormal when the monitored voltage is lower than a reference voltage.

Abnormalities that occur in a capacitor discharge ignition device include a break in a component that constitutes an ignition circuit, an abnormality that occurs in an ignition circuit such as a short circuit or a wire break, an abnormality of an ignition power supply portion such that a charging power supply voltage is not applied to an ignition capacitor due to an improper connection between the ignition power supply portion and the ignition circuit, and an abnormality of an ignition coil such as a break in a primary coil of an ignition coil or a disconnection of a wire connecting between the ignition coil and the ignition circuit.

As described above, in the method for diagnosing an abnormality disclosed in Japanese Patent Application Laid-Open Publication No. 8-135548, it is determined that the ignition device is abnormal when the charging voltage at the time when the predetermined time has elapsed from the charging start time of the ignition capacitor is lower than the reference voltage. When there is an abnormality in the ignition power supply portion, and a voltage across the ignition capacitor does not increase to a normal value, the abnormality of the ignition device can be diagnosed by the method disclosed in Japanese Patent Application Laid-Open Publication No. 8-135548.

In this case, when the ignition power supply portion is normal and the ignition power supply portion normally outputs a capacitor charging voltage, the diagnosis device detects the output voltage of the ignition power supply portion as a charging voltage of the ignition capacitor even if there is an abnormality in the ignition coil, and when the value of the detected voltage is the value or more of a normal charging voltage across the ignition capacitor, it is improperly determined that the ignition device is normal though it is abnormal.

SUMMARY OF THE INVENTION

The present invention has an object to provide a diagnosis device of a capacitor discharge ignition device for an engine that can properly detect an abnormality of an ignition power supply portion and also an abnormality of an ignition coil.

The present invention is directed to a diagnosis device of a capacitor discharge ignition device for an engine that diagnoses the capacitor discharge ignition device for an engine including: an ignition power supply portion that repeatedly outputs a capacitor charging voltage of a pulse waveform; an ignition coil; an ignition capacitor connected in series with a primary coil of the ignition coil and charged with an output voltage of the ignition power supply portion through the primary coil; a discharge switch that conducts when receiving an ignition signal and discharges charges accumulated in the ignition capacitor through the primary coil of the ignition coil; and an ignition position control portion that provides an ignition signal to the discharge switch at an ignition position of the engine, the capacitor discharge ignition device for an engine inducing a high voltage for ignition in a secondary coil of the ignition coil by the discharge of the charges accumulated in the ignition capacitor.

In the present invention, the diagnosis device includes: singularity detection means for detecting, as a singularity, a leading edge or a trailing edge of a voltage between output terminals of the ignition power supply portion; singularity counting means for counting the number of singularities detected by the singularity detection means while a crankshaft rotates through a measurement section, which is a section of a certain crank angle determined with reference to a pulse signal obtained by a signal generator that generates a pulse signal at a specific crank angle position of the engine; and diagnosis means for diagnosing an abnormality of the ignition device and a cause of the abnormality by comparing the number of singularities counted by the singularity counting means with the number of times of normal ignition of the engine performed while the crankshaft rotates through the measurement section.

In a preferred aspect of the present invention, the diagnosis means is comprised so as to determine that the ignition device is normal when the number of singularities counted by the singularity counting means is equal to the number of times of normal ignition of the engine performed while the crankshaft rotates through the measurement section, determine that the capacitor charging voltage is not provided from the ignition power supply portion when the number of singularities counted by the singularity counting means is zero, and determine that the ignition coil is not electrically normally connected to the ignition capacitor and a charging circuit of the ignition capacitor is thus not established when the number of singularities counted by the singularity counting means is not equal to the number of times of normal ignition of the engine performed while the crankshaft rotates through the measurement section and is not zero.

The state where the ignition coil is not electrically connected to the ignition capacitor is, for example, a state where the ignition coil is disconnected or there is a break in the primary coil of the ignition coil.

As described above, the leading edge or the trailing edge of the voltage between the output terminals of the ignition power supply portion is detected as a singularity, the number of singularities that appear while the crankshaft rotates through a certain measurement section is counted, and the counted number of singularities is compared with the number of times of normal ignition of the engine performed while the crankshaft rotates through the measurement section. Thus, it can be determined that the ignition device is normal when the counted number of singularities is equal to the number of times of normal ignition, and that the ignition device is abnormal when the counted number of singularities is not equal to the number of times of normal ignition.

In a preferred aspect of the present invention, the diagnosis means is comprised so as to determine that the ignition device is normal when the number of singularities counted by the singularity counting means is equal to the number of times of normal ignition of the engine performed while the crankshaft rotates through the measurement section, determine that the capacitor charging voltage is not provided from the ignition power supply portion when the number of singularities counted by the singularity counting means is zero, and determine that the ignition coil is not electrically normally connected to the ignition capacitor and the charging circuit of the ignition capacitor is thus not established when the number of singularities counted by the singularity counting means is not equal to the number of times of normal ignition of the engine performed while the crankshaft rotates through the measurement section and is not zero.

In another preferred aspect of the present invention, the ignition power supply portion is comprised so that the number of times of the ignition power supply portion generating the capacitor charging voltage while the crankshaft rotates through the measurement section is different from the number of times of normal ignition of the engine to be performed while the crankshaft rotates through the measurement section, and the diagnosis means is comprised so as to determine that the ignition device is normal when the number of singularities counted by the singularity counting means is equal to the number of times of normal ignition of the engine performed while the crankshaft rotates through the measurement section, determine that the ignition coil is not electrically normally connected to the ignition capacitor and the charging circuit of the ignition capacitor is thus not established when the number of singularities counted by the singularity counting means is equal to the number of times of the ignition power supply portion generating the capacitor charging voltage while the crankshaft rotates through the measurement section, determine that the capacitor charging voltage is not provided from the ignition power supply portion when the number of singularities counted while the crankshaft rotates through the measurement section is zero, and determine that there is a different unexpected abnormality when the number of singularities counted by the singularity counting means is not zero and is not equal to the number of times of normal ignition performed while the crankshaft rotates through the measurement section nor equal to the number of times of the ignition power supply portion generating the capacitor charging voltage while the crankshaft rotates through the measurement section.

As described above, the number of singularities counted by the singularity counting means is compared with the number of times of normal ignition of the engine performed while the crankshaft rotates through the measurement section, and also the number of singularities counted by the singularity counting means is compared with the number of times of the ignition power supply portion generating the capacitor charging voltage while the crankshaft rotates through the measurement section. Thus, the state where the ignition coil is not electrically connected to the ignition capacitor and the state where the capacitor charging voltage is not provided from the ignition power supply portion can be determined as abnormal states, and also an unexpected abnormality other than the above described abnormalities can be determined, thereby allowing a cause of an abnormality of the ignition device to be diagnosed in more detail.

In a further preferred aspect of the present invention, the diagnosis device includes: singularity detection means for detecting, as a singularity, a leading edge or a trailing edge of a voltage between output terminals of the ignition power supply portion; singularity counting means for incrementing a count value for each detection of the singularity by the singularity detection means and storing the count value as the number of singularities; diagnosis means for diagnosing an abnormality of the ignition device and a cause of the abnormality from the number of singularities having been counted by the singularity counting means when a determination timing is detected that is determined based on a pulse signal obtained by a signal generator that generates a pulse signal at a specific crank angle position of the engine; and memory contents reset means for clearing memory contents of the singularity counting means when the diagnosis means completes the diagnosis.

The ignition power supply portion is comprised so that when a time period between the last determination timing and this determination timing is one determination time period, the number of times of the ignition power supply portion generating the capacitor charging voltage during each determination time period is different from the number of times of normal ignition of the engine to be performed during each determination time period.

In this case, the diagnosis means is comprised so as to determine that the ignition device is normal when the number of singularities having been counted by the singularity counting means at the determination timing is equal to the number of times of normal ignition of the engine performed during the determination time period, determine that the capacitor charging voltage is not provided from the ignition power supply portion when the number of singularities having been counted by the singularity counting means at the determination timing is zero, determine that the ignition coil is not electrically normally connected to the ignition capacitor and the charging circuit of the ignition capacitor is thus not established when the number of singularities having been counted by the singularity counting means at the determination timing is equal to the number of times of the ignition power supply portion generating the capacitor charging voltage during the determination time period, and determine that there is a different unexpected abnormality when the number of singularities having been counted by the singularity counting means at the determination timing is not zero and is not equal to the number of times of normal ignition performed during each determination time period nor equal to the number of times of generation of the capacitor charging voltage during each determination time period.

In the present invention, when the diagnosis is not performed based on the comparison between the number of singularities having been counted by the singularity counting means and the number of times of the ignition power supply portion generating the capacitor charging voltage during the determination time period, the ignition power supply portion may be comprised of a battery and a DC converter that increases an output voltage of the battery. In this case, the state where the capacitor charging voltage is not provided from the ignition power supply portion is a state where the battery is disconnected or the DC converter is broken.

When the diagnosis is not performed based on the comparison between the number of singularities having been counted by the singularity counting means and the number of times of the ignition power supply portion generating the capacitor charging voltage during the determination time period, the ignition power supply portion may include an exciter coil that is provided in a magneto generator driven by the engine and generates an AC voltage in synchronization with rotation of the engine, and a rectifier circuit that half-wave or full-wave rectifies the output voltage of the exciter coil and provides the voltage across a series circuit of the ignition capacitor and the primary coil of the ignition coil. In this case, the state where the capacitor charging voltage is not provided from the ignition power supply portion is a state where the exciter coil is disconnected or the rectifier circuit is broken and cannot output the capacitor charging voltage.

When the ignition power supply portion is comprised of the battery and the DC converter that increases the output voltage of the battery, the diagnosis device according to the present invention may include: singularity detection means for detecting, as a singularity, a leading edge or a trailing edge of a voltage between output terminals of the ignition power supply portion; singularity counting means for incrementing a count value for each detection of the singularity by the singularity detection means and storing the count value as the number of singularities; diagnosis means for diagnosing an abnormality of the ignition device and a cause of the abnormality from the number of singularities having been counted by the singularity counting means when a determination timing is detected that is determined based on a pulse signal obtained by a signal generator that generates a pulse signal at a specific crank angle position of the engine; and memory contents reset means for clearing memory contents of the singularity counting means when the diagnosis means completes the diagnosis.

In this case, the diagnosis means is comprised so as to determine that the ignition device is normal when the number of singularities having been counted by the singularity counting means at the determination timing is equal to the number of times of normal ignition of the engine to be performed between the last determination timing and this determination timing, determine that the ignition coil is not electrically normally connected to the ignition capacitor and the charging circuit of the ignition capacitor is thus not established when the number of singularities having been counted by the singularity counting means at the determination timing is not equal to the number of times of normal ignition of the engine to be performed between the last determination timing and this determination timing, and determine that the battery is disconnected or the DC converter is broken when the number of singularities having been counted by the singularity counting means at the determination timing is zero.

Also when the number of singularities having been counted by the singularity counting means is compared with the number of times of the ignition power supply portion generating the capacitor charging voltage during the determination time period to determine whether the ignition coil is eclectically connected to the ignition capacitor, the ignition power supply portion may include an exciter coil that is provided in a magneto generator driven by the engine and generates an AC voltage in synchronization with rotation of the engine, and a rectifier circuit that half-wave or full-wave rectifies the output voltage of the exciter coil and provides the voltage across a series circuit of the ignition capacitor and the primary coil of the ignition coil. In this case, the state where the capacitor charging voltage is not provided from the ignition power supply portion is a state where the exciter coil is disconnected or a state where the rectifier circuit is broken and cannot output the capacitor charging voltage.

When the number of singularities having been counted by the singularity counting means is compared with the number of times of the ignition power supply portion generating the capacitor charging voltage during the determination time period to determine whether the ignition coil is electrically connected to the ignition capacitor, the ignition power supply portion may include an exciter coil that is provided in a magneto generator driven by the engine and generates an AC voltage in synchronization with rotation of the engine, and a boost circuit that passes a short-circuit current through the exciter coil when a voltage of a half wave having one polarity is induced in the exciter coil, and interrupts the short-circuit current to induce an increased pulse voltage in the exciter coil when the short-circuit current becomes a set value or more. In this case, the state where the capacitor charging voltage is not provided from the ignition power supply portion is a state where the exciter coil is disconnected or a state where the boost circuit is broken and cannot output the capacitor charging voltage.

Also when the number of singularities having been counted by the singularity counting means is compared with the number of times of the ignition power supply portion generating the capacitor charging voltage during the determination time period to determine whether the ignition coil is eclectically connected to the ignition capacitor, the ignition power supply portion may include an exciter coil that is provided in a magneto generator driven by the engine and generates an AC voltage in synchronization with rotation of the engine, and a rectifier circuit that half-wave or full-wave rectifies the output voltage of the exciter coil and provides the voltage across a series circuit of the ignition capacitor and the primary coil of the ignition coil. In this case, the state where the capacitor charging voltage is not provided from the ignition power supply portion is a state where the exciter coil is disconnected or a state where the rectifier circuit is broken and cannot output the capacitor charging voltage.

According to the present invention, the leading edge or the trailing edge of the voltage between the output terminals of the ignition power supply portion is detected as a singularity, the number of singularities that appear while the crankshaft rotates through a certain measurement section is counted, and the counted number of singularities is compared with the number of times of normal ignition of the engine performed while the crankshaft rotates through the measurement section. Thus, it can be determined that the ignition device is normal when the counted number of singularities is equal to the number of times of normal ignition, and that the ignition device is abnormal when the counted number of singularities is not equal to the number of times of normal ignition.

According to the present invention, it can be determined that the capacitor charging voltage is not provided from the ignition power supply portion when the number of singularities counted by the singularity counting means is zero, and that the ignition coil is not electrically normally connected to the ignition capacitor and the charging circuit of the ignition capacitor is thus not established when the number of singularities counted by the singularity counting means is not equal to the number of times of normal ignition of the engine performed while the crankshaft rotates through the measurement section and is not zero, thereby allowing a cause of an abnormality of the ignition device to be diagnosed.

Particularly in the present invention, the number of singularities counted by the singularity counting means is compared with the number of times of normal ignition of the engine performed while the crankshaft rotates through the measurement section, and also the number of singularities counted by the singularity counting means is compared with the number of times of the ignition power supply portion generating the capacitor charging voltage while the crankshaft rotates through the measurement section. Thus, the state where the ignition coil is not electrically connected to the ignition capacitor and the state where the capacitor charging voltage is not provided from the ignition power supply portion can be determined as abnormal states, and also an unexpected abnormality other than the above described abnormalities can be determined, thereby allowing a cause of an abnormality of the ignition device to be diagnosed in more detail.

BRIEF DESCRIPTION OF THE DRAWINGS

The above and other objects and features of the invention will be apparent from the detailed description of the preferred embodiments of the invention, which is described and illustrated with reference to the accompanying drawings, in which;

FIG. 1 is a schematic circuit diagram of an exemplary construction of hardware according to a first embodiment of the present invention;

FIGS. 3A to 3D are waveform charts showing, with respect to crank angles of an engine, a signal waveform and a voltage waveform of each part in a normal state in the embodiment in FIG. 1;

FIGS. 4A to 4C are waveform charts showing, with respect to the crank angles of the engine, a signal waveform and a voltage waveform of each part at the time when a charging circuit of an ignition capacitor is not established because an ignition coil is disconnected or the like in the embodiment in FIG. 1;

FIGS. 5A to 5C are waveform charts showing, with respect to the crank angles of the engine, a signal waveform and a voltage waveform of each part at the time when a capacitor charging voltage is not generated because an exciter coil is disconnected or the like in the embodiment in FIG. 1;

FIGS. 10A to 10D are waveform charts showing, with respect to crank angles of an engine, a signal waveform and a voltage waveform of each part in a normal state in the embodiment in FIG. 9;

FIGS. 11A to 11D are waveform charts showing, with respect to the crank angles of the engine, a signal waveform and a voltage waveform of each part at the time when a charging circuit of an ignition capacitor is not established because an ignition coil is disconnected or the like in the embodiment in FIG. 9;

FIGS. 12A to 12D are waveform charts showing, with respect to the crank angles of the engine, a signal waveform and a voltage waveform of each part at the time when a capacitor charging voltage is not generated because an exciter coil is disconnected or the like in the embodiment in FIG. 9;

FIG. 13 is a flowchart of an example of an algorithm of a determination processing performed by a microprocessor for comprising diagnosis means in the embodiment in FIG. 9.

DETAILED DESCRIPTION OF THE PREFERRED EMBODIMENTS

Figure 2:
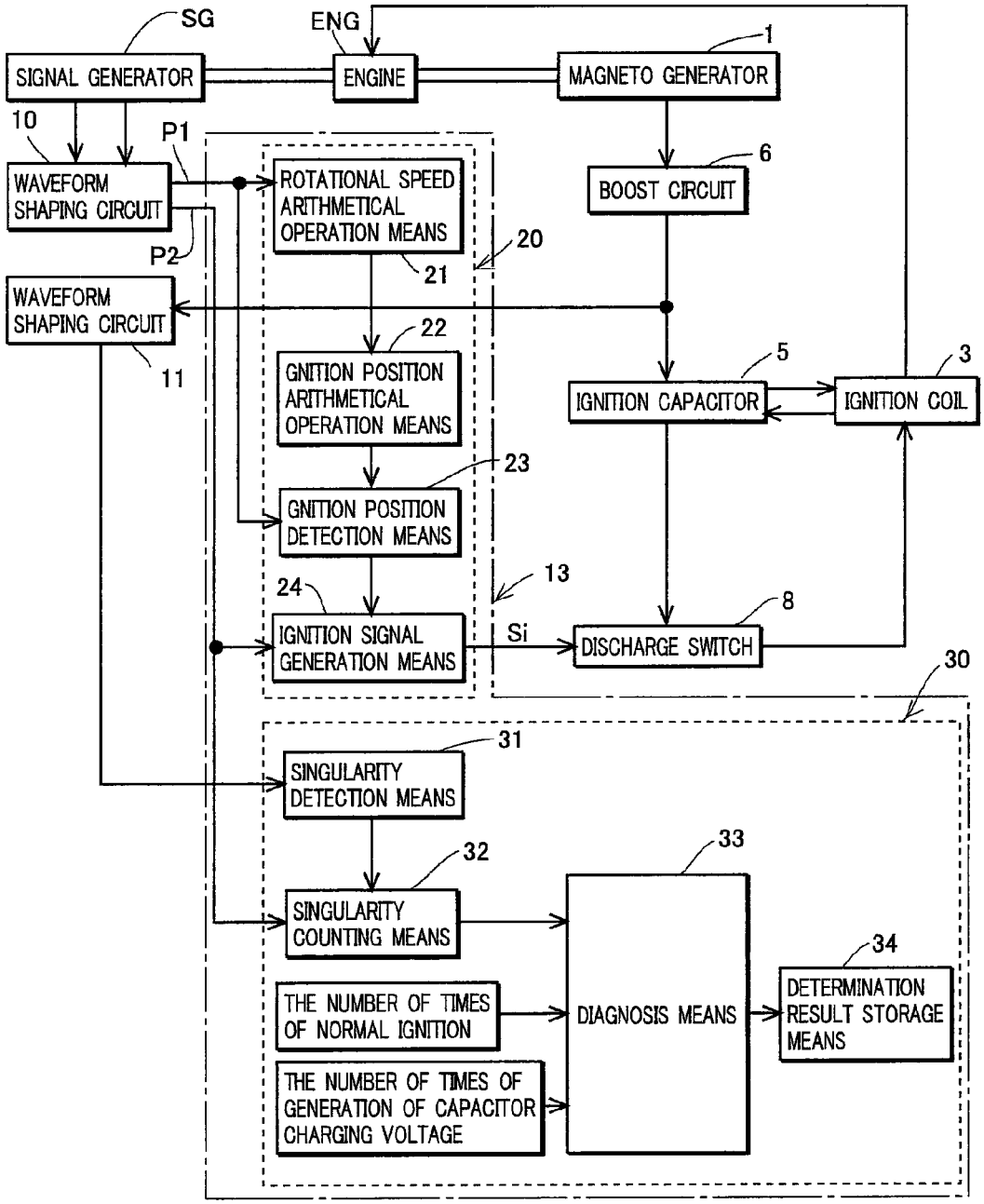
FIG. 2 is a block diagram of a construction of an entire system including means comprised by a microprocessor in the embodiment in FIG. 1.

Now, preferred embodiments of the present invention will be described in detail with reference to the drawings.

FIG. 1 shows a construction of an ignition device according to a first embodiment of the present invention. In FIG. 1, a reference numeral 1 denotes a magneto generator driven by an unshown engine. The generator is comprised of a rotor 1A mounted to a crankshaft of the engine, and a stator 1B mounted to a case or the like of the engine. The rotor 1A includes a cup-like rotor yoke 1*a*1, and a permanent magnet (not shown) mounted to an inner periphery of a peripheral wall portion of the rotor yoke. The stator 1B includes a stator iron core having a magnetic pole portion facing a magnetic pole of the rotor, and an exciter coil EX wound around the stator iron core.

The present invention may be applied to a two-cycle engine and a four-cycle engine, and a two-cycle engine is herein exemplified having two cylinders ignited at 180° intervals.

On an outer periphery of the rotor yoke 1*a*1 of the magneto generator 1, two reluctors (inductors) r1 and r2 corresponding to the two cylinders of the engine are provided. The shown reluctors r1 and r2 are comprised of arcuate protrusions extending circumferentially of the rotor yoke 1*a*1 with a predetermined polar arc angle, and provided at 180° intervals circumferentially of the rotor yoke.

On the outside of the rotor yoke 1*a*1, a pulser 2 is placed mounted to a fixed location such as the case of the engine. The pulser 2 is a known one including a signal coil SC wound around an iron core having a magnetic pole portion that faces the reluctor r1 and r2, and a permanent magnet connected to the iron core around which the signal coil SC is wound. The pulser 2 induces pulse signals having different polarities in the signal coil SC when detecting a front edge and a rear edge in a rotational direction of each of the reluctors r1 and r2 at a specific crank angle position of the engine.

FIG. 3 shows a signal waveform and a voltage waveform of each parts of the ignition device in FIG. 1, representing the crank angle (a rotational angle of the crankshaft) θ on the axis of abscissa. In FIG. 3, reference numerals #1 and #2 denote relations to a first cylinder and a second cylinder, respectively, of the engine. A reference numerals #1TDC and #2TDC denote top dead center positions of the first cylinder and the second cylinder, respectively, of the engine (crank angle positions at the time when pistons of the first cylinder and the second cylinder reach the top dead center).

As shown in FIG. 3A, the pulser 2 in the embodiment detects the front edge in the rotational direction of the reluctor r1 and induces a reference pulse signal Vs1 for the first cylinder in the signal coil SC when the crank angle position of the engine matches a reference crank angle position θ11 of the first cylinder set to a position sufficiently advanced from the top dead center position #1TDC of the first cylinder of the engine (the crank angle position corresponding to the top dead center of the first cylinder), and detects the rear edge in the rotational direction of the reluctor r1 and induces a reference ignition position signal Vs2 for the first cylinder of a pulse waveform in the signal coil SC when the crank angle position of the engine matches a reference ignition position θ21 for the first cylinder (an ignition position when an amount of advance is zero) set near the top dead center position of the first cylinder #1TDC.

The pulser 2 also detects the front edge of the reluctor r2 and induces a reference pulse signal Vs1 for the second cylinder in the signal coil SC when the crank angle position of the engine matches a reference crank angle position θ12 of the second cylinder set to a position sufficiently advanced from the top dead center position #2TDC of the second cylinder of the engine, and detects the rear edge of the reluctor r2 and induces a reference ignition position signal Vs2 for the second cylinder of a pulse waveform in the signal coil SC when the crank angle position of the engine matches a reference ignition position θ22 for the second cylinder set near the top dead center position #2TDC of the second cylinder.

In the embodiment, the pulse signal Vs1 generated when the pulser 2 detects the front edge in the rotational direction of each reluctor is comprised of a pulse having a negative polarity, and the pulse signal Vs2 generated when the pulser 2 detects the rear edge in the rotational direction of each reluctor is comprised of a pulse having a positive polarity. However, the pulse signal Vs1 generated when the pulser 2 detects the front edge in the rotational direction of each reluctor may be comprised of a pulse having a positive polarity, and the pulse signal Vs2 generated when the pulser 2 detects the rear edge in the rotational direction of each reluctor may be comprised of a pulse having a negative polarity.

In the embodiment, the reference pulse signal Vs1 generated when the pulser 2 detects the front edge of each of the reluctors r1 and r2 is used as a signal for determining timing for starting measurement of ignition positions of the first cylinder and the second cylinder arithmetically operated with respect to various control conditions.

At the start and during low speed rotation of the engine when proper detection of the arithmetically operated ignition positions is difficult because of frequently varying rotational speed of the crankshaft, the ignition positions of the first cylinder and the second cylinder are not determined by the arithmetical operation but ignition is performed at a reference ignition position set near the top dead center position. In the embodiment, the ignition signals for the first cylinder and the second cylinder are generated when the pulser 2 detects the rear edges in the rotational direction of the reluctors r1 and r2 and generates the reference ignition position signal Vs2 at the start and during low speed rotation of the engine.

In the embodiment, the pulse signal Vs2 generated when the pulser 2 detects the rear edges in the rotational direction of the reluctors r1 and r2 is used as the reference ignition position signal and also as a signal for determining determination timing in diagnosing the ignition device.

In the embodiment, the rotor for generating a signal is comprised of the rotor yoke 1*a*1 on which the reluctors r1 and r2 are formed, and a signal generator SG that generate a pulse signal at a specific crank angle position of the engine is comprised of the rotor and the pulser 2.

In FIG. 1, a reference numeral 3 denotes an ignition coil having primary coils 3*a* and 3*b*, and 4 denotes an ignition unit including electronic components required for the construction of the ignition device and a microprocessor integral with each other. One end of the primary coil 3*a* of the ignition coil is grounded in the ignition unit, and one end and the other end of the secondary coil 3*b* are connected to non-ground terminals of ignition plugs PL1 and PL2 mounted to the first and second cylinders, respectively, of the engine.

In the ignition unit 4, there are provided an ignition capacitor 5 connected in series with the primary coil of the ignition coil, a boost circuit 6 that increases an output voltage of a half wave having one polarity (in this example, a half wave having a positive polarity) of the exciter coil EX, a diode 7 that constitutes a rectifier circuit that half-wave rectifies the output voltage of the exciter coil EX and applies the voltage across a series circuit of the ignition capacitor 5 and the primary coil 3*a*, a discharge switch 8 that conducts when receiving an ignition signal Si and discharges charges accumulated in the ignition capacitor 5 through the primary coil 3*a* of the ignition coil, a microprocessor 9 that performs an arithmetical operation for controlling the ignition position, a waveform shaping circuit 10 that converts the pulse signals Vs1 and Vs2 generated by the signal coil SC into signals P1 and P2 of waveforms recognizable by the microprocessor 9, and inputs the signals to the microprocessor 9, and a waveform shaping circuit 11 that converts a voltage between output terminals of an ignition power supply portion (a voltage across the ignition capacitor 5) into a signal that changes its level at a leading edge and a trailing edge thereof. Outputs of the waveform shaping circuit 10 and the waveform shaping circuit 11 are input to a predetermined port of the microprocessor 9.

More specifically, the ignition capacitor 5 has one end connected to a non-ground terminal of the primary coil 3*a* of the ignition coil and is thus connected in series with the primary coil 3*a*.

The discharge switch 8 is comprised of a switch element, for example, a thyristor having a self-hold function of holding an on state while a current at a holding level or higher passes, and connected between the other end of the ignition capacitor 5 and the ground (between the other end of the ignition capacitor 5 and one end of the primary coil 3*a*). When the thyristor is used as the discharge switch 8, an anode thereof is connected to the other end of the ignition capacitor 5 and a cathode is connected to one end of the primary coil 3*a* (the ground).

The boost circuit 6 passes a short-circuit current in the exciter coil when a voltage of a half wave having one polarity is induced in the exciter coil EX, and interrupts the short-circuit current to induce an increased pulse voltage in the exciter coil EX when the short-circuit current becomes a set value or more.

The boost circuit 6 is comprised of, for example, an exciter short-circuiting switch that is connected in parallel with the exciter coil EX, and conducts to short-circuit the exciter coil when the exciter coil generates a voltage of a half wave having one polarity, and a circuit that performs control to turn off the exciter short-circuiting switch when the short-circuit current passing through the exciter coil becomes a set value or more, and induces a high voltage in the exciter coil EX. Such a boost circuit is known as disclosed in Japanese Utility Model Application Laid-Open Publication No. 60-41581.

In the embodiment, the ignition power supply portion that repeatedly outputs a capacitor charging voltage of a pulse waveform is comprised of the exciter coil EX, the boost circuit 6, and the diode 7. The ignition capacitor 5 is charged with the output voltage of the ignition power supply portion to a shown polarity through the primary coil 3*a*.

In the ignition unit 4, an ignition circuit 12 is comprised of the ignition capacitor 5, the boost circuit 6, the diode 7, and the discharge switch 8. A control portion 13 is comprised of the microprocessor 9 and the waveform shaping circuits 10 and 11. The microprocessor 9 in the control portion 13 performs a predetermined program to comprise an ignition position control portion that controls the ignition position of the engine, and a diagnosis device that diagnoses the ignition device. The exciter coil EX and the primary coil 3*a* of the ignition coil are connected to the ignition circuit 12 by an external wire, and the pulser SC is connected to the waveform shaping circuit 10 through an external wire.

FIG. 2 is a block diagram of constructions of the ignition device of the embodiment including various means comprised by the microprocessor 9 and the diagnosis device that diagnoses the ignition device. In FIG. 2, a reference numeral 21 denotes rotational speed arithmetical operation means, which arithmetically operates a rotational speed of the engine ENG from a cycle of generation of a pulse signal by the pulser 2.

A reference numeral 22 denotes ignition position arithmetical operation means, which arithmetically operates an ignition position of the engine ENG with respect to the rotational speed arithmetically operated by the rotational speed arithmetical operation means 21, and further arithmetically operates clocking data measured by an ignition timer for detecting the arithmetically operated ignition position.

A reference numeral 23 denotes ignition position detection means, which sets the clocking data arithmetically operated by the ignition position arithmetical operation means 22 in the ignition timer and starts measurement thereof when the signal generator SG generates the reference pulse signal Vs1.

A reference numeral 24 denotes ignition signal generation means for generating an ignition signal Si and providing the signal to the discharge switch when the ignition timer completes measurement of the set clocking data, and the ignition position control portion 20 is comprised of the rotational speed arithmetical operation means 21 to the ignition signal generation means 24.

In the ignition device in FIG. 1, an output voltage of a half wave having one polarity of the exciter coil EX is increased by the boost circuit 6. In the embodiment, the rotor of the magneto generator 1 has twelve poles, and the exciter coil EX generates an AC voltage of six cycles during one turn of the crankshaft. The boost circuit 6 increases the voltage of a half wave having one polarity generated by the exciter coil, and generates a capacitor charging voltage V0 of a pulse waveform as shown in FIG. 4 six times during one turn of the crankshaft. The six capacitor charging voltages V0 are applied across the series circuit of the ignition capacitor 5 and the primary coil 3*a* of the ignition coil through the diode 7, and thus the ignition capacitor 5 is gradually charged to the shown polarity, and the voltage Vc between the output terminals of the ignition power supply portion (the voltage across the series circuit of the ignition capacitor 5 and the primary coil 3*a*) increases as shown in FIG. 3C.

The rotational speed arithmetical operation means 21 arithmetically operates the rotational speed of the engine from a generation interval of a specific pulse signal output by the signal generator SG. For example, the rotational speed arithmetical operation means 21 reads time between generation of the last reference pulse signal and generation of this reference pulse signal (time required for the crankshaft to rotate a half turn) for each generation of the reference pulse signal Vs1, and arithmetically operates the rotational speed of the engine from the read time. The rotational speed of the engine may be arithmetically operated from time between generation of the last but one reference pulse signal and generation of this reference pulse signal (time required for the crankshaft to rotate one turn).

The ignition position arithmetical operation means 22 arithmetically operates an ignition position by searching an ignition position arithmetical operation map with respect to the arithmetically operated rotational speed, and further arithmetically operates time required for the crankshaft to rotate from a reference crank angle position to the arithmetically operated ignition position at the current rotational speed as clocking data for detecting an ignition position (clocking data measured by an ignition timer for detecting the arithmetically operated ignition position).

The ignition position detection means 23 sets the clocking data for detecting an ignition position in the ignition timer and starts the measurement thereof when the reference pulse signal Vs1 is generated. The ignition signal generation means 24 provides the ignition signal Si to the discharge switch 8 when the ignition timer completes the measurement of the set clocking data. Thus, the discharge switch 8 conducts, and instantaneously discharges charges accumulated in the ignition capacitor 5 through the primary coil of the ignition coil. By the discharge, a high voltage for ignition is induced in the secondary coil 3*b* of the ignition coil 3. Since the high voltage is simultaneously applied to the ignition plugs PL1 and PL2 mounted to the first cylinder and the second cylinder, respectively, of the engine, spark discharge simultaneously occurs in both the ignition plugs, and ignition is performed in one of the two cylinders at ignition timing.

A diagnosis device 30 according to the present invention is comprised of singularity detection means 31, singularity counting means 32, diagnosis means 33, and determination result storage means 34 for storing a determination result by the diagnosis means 33.

The singularity detection means 31 detects, as a singularity, the leading edge or the trailing edge of the voltage Vc between the output terminals of the ignition power supply portion from the output of the waveform shaping circuit 11 that converts the voltage Vc between the output terminals of the ignition power supply portion into a signal that changes its level at the leading edge and the trailing edge thereof. The number of singularities is equal to the number of times of charge or discharge of the ignition capacitor.

The singularity counting means 32 counts and stores the number of singularities detected by the singularity detection means 31 while the crankshaft rotates through a measurement section, which is a section of a certain crank angle determined with reference to a pulse signal obtained by a signal generator that generates a pulse signal at a specific crank angle position of the engine.

As shown in FIG. 1, the waveform shaping circuit 11 used in the embodiment is comprised of a comparator CP1, a reference voltage generation circuit 11*a* that is comprised of a series circuit of resistances Ra and Rb across which a constant voltage Ec provided from an unshown constant voltage power supply circuit is applied, and provides a voltage across the resistance Rb to a non-inverting input terminal (+ terminal) of the comparator CP1 as a reference voltage Vf, and a voltage detection circuit 11*b* that is comprised of a DC circuit of resistances Rc and Rd across which the voltage Vc between the other end of the ignition capacitor 5 and the ground (between the output terminals of the ignition power supply portion) is applied, and provides a voltage across the resistance Rd to an inverting input terminal (– terminal) of the comparator CP1 as a detection signal Vcs of the output voltage of the ignition power supply portion. The shown waveform shaping circuit 11 outputs, from the comparator CP1, a rectangular wave signal Sq that represents a low level when the detection signal Vcs of the output voltage of the ignition power supply portion is higher than the reference voltage Vf, and represents a high level when the detection signal Vcs is the reference voltage Vf or lower. Specifically, as shown in FIG. 3D, the waveform shaping circuit 11 converts the voltage Vc between the output terminals of the ignition power supply portion into the rectangular wave signal Sq that changes its level to the high level at the trailing edge, and to the low level at the leading edge. The microprocessor interrupts a processing under execution when detecting the leading edge or the trailing edge of the level of the signal Sq to detect the singularity.

Figure 7:
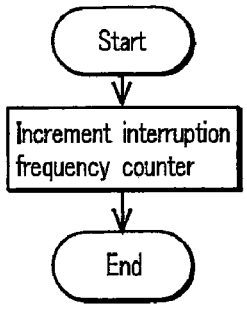
FIG. 7 is a flowchart of an example of an algorithm of a processing performed by the microprocessor for comprising singularity counting means in the embodiment in FIG. 1.

The singularity detection means 31 used in the embodiment detects, as a singularity a, the trailing edge (the leading edge of the voltage Vc between the output terminals of the ignition power supply portion) of the level of the signal Sq output by the waveform shaping circuit 11, and interrupts a processing under execution to perform an interruption processing in FIG. 7. In the interruption processing in FIG. 7, a count value of an interruption frequency counter is incremented for each detection of the singularity a to count the number of singularities. In the embodiment, the singularity detection means 31 and the singularity counting means 32 are comprised by the microprocessor performing the processing in FIG. 7.

If it is supposed that the ignition device normally operates, and a rotational angle section of the crankshaft including at least one of sections between the start of each charge and discharge of the ignition capacitor 5 is a measurement section θd in a normal state of the ignition device, the number of singularities counted in the measurement section is equal to the number of times of normal ignition to be performed while the crankshaft rotates through the measurement section.

The measurement section θd can be determined based on a specific pulse signal generated by the signal generator SG. For example, as shown in FIG. 3, a reference ignition position signal Vs2 generated by the signal generator SG is waveform-shaped to obtain a pulse signal P2, and a section twice a generation interval of the pulse signal P2 (a section corresponding to one turn of the crankshaft) can be determined as the measurement section θd. When the measurement section is thus determined, the number of singularities a counted while the crankshaft rotates through the measurement section in the normal state of the ignition device is two, and the number of times of normal ignition performed while the crankshaft rotates through the measurement section is also two.

On the other hand, when the primary coil 3*a* of the ignition coil 3 is disconnected or the primary coil is broken, and the primary coil of the ignition coil is not electrically normally connected to the ignition capacitor, a charging circuit of the ignition capacitor 5 is not established and the ignition capacitor is not charged. Thus, as shown in FIG. 4B, a waveform of the voltage Vc between the output terminals of the ignition power supply portion (across the series circuit of the ignition capacitor and the primary coil of the ignition coil) is equal to a waveform of the capacitor charging voltage V0 applied from the exciter coil EX through the boost circuit 6 and the diode 7 (applied from the ignition power supply portion).

At this time, the number of singularities a counted while the crankshaft rotates through the measurement section θd is equal to the number of times of the ignition power supply portion generating the capacitor charging voltage V0 while the crankshaft rotates through the measurement section θd (six times in the embodiment).

When the exciter coil EX is disconnected or the boost circuit 6 is broken, thus the boost circuit short-circuits the exciter coil or the like, and as shown in FIG. 5B, the capacitor charging voltage V0 is not applied from the ignition power supply portion across the series circuit of the ignition capacitor and the primary coil, no singularity is detected, and thus the number of singularities measured while the crankshaft rotates through the measurement section θd is zero.

Thus, if the ignition power supply portion is comprised so that the number of times of the ignition power supply portion generating the capacitor charging voltage while the crankshaft rotates through the measurement section is not equal to the number of times of normal ignition of the engine to be performed while the crankshaft rotates through the measurement section, the number of singularities counted while the crankshaft rotates through the measurement section is equal to the number of times of normal ignition performed while the crankshaft rotates through the measurement section in the normal state of the ignition device, while the number of singularities counted while the crankshaft rotates through the measurement section is not equal to the number of times of normal ignition performed while the crankshaft rotates through the measurement section when the primary coil of the ignition coil is not electrically connected to the ignition capacitor and the ignition capacitor is thus not charged, or the capacitor charging voltage is not provided from the ignition power supply portion. Thus, it can be determined that the ignition device is normal when the number of singularities counted while the crankshaft rotates through the measurement section is equal to the number of times of normal ignition performed while the crankshaft rotates through the measurement section, and it can be determined that the ignition device is abnormal when they are not equal.

When the number of singularities a counted while the crankshaft rotates through the measurement section θd is equal to the number of times of the ignition power supply portion generating the capacitor charging voltage while the crankshaft rotates through the measurement section θd, it can be determined that the ignition power supply portion is normal but the ignition coil is not electrically normally connected to the ignition capacitor and the charging circuit of the ignition capacitor is thus not established, and when the number of singularities a counted while the crankshaft rotates through the measurement section θd is zero, it can be determined that there is an abnormality in the ignition power supply portion and the ignition power supply portion does not generate the capacitor charging voltage.

The singularity counting means 32 counts the number of singularities detected by the singularity detection means 31 while the crankshaft rotates through the measurement section θd, which is a section of a certain crank angle determined (in this example, a section corresponding to one turn of the crankshaft) with reference to a pulse signal (the reference ignition position signal Vs2 in the embodiment) obtained by the signal generator SG that generates a pulse signal at a specific crank angle position of the engine.

The diagnosis means 33 in FIG. 2 is comprised so as to determine that the ignition device is normal when the number of singularities counted by the singularity counting means 31 while the crankshaft rotates through the measurement section is equal to the number of times of normal ignition of the engine performed while the crankshaft rotates through the measurement section, determine that the ignition coil is not electrically normally connected to the ignition capacitor and the charging circuit of the ignition capacitor is thus not established when the number of singularities counted by the singularity counting means is equal to the number of times of the ignition power supply portion generating the capacitor charging voltage while the crankshaft rotates through the measurement section, determine that the capacitor charging voltage is not provided from the ignition power supply portion when the number of singularities counted while the crankshaft rotates through the measurement section is zero, and determine that there is a different unexpected abnormality when the number of singularities counted by the singularity counting means is not zero and is not equal to the number of times of normal ignition performed while the crankshaft rotates through the measurement section nor the number of times of the ignition power supply portion generating the capacitor charging voltage while the crankshaft rotates through the measurement section.

In the actual determination processing performed by the microprocessor, a determination timing is determined based on the pulse signal obtained by the signal generator SG at the specific crank angle position of the engine, and an abnormality of the ignition device and a cause of the abnormality are diagnosed from the number of singularities having been counted by the singularity counting means when the determined determination timing is detected.

In the example in FIGS. 3 to 5, timing when the pulse signal P2 obtained by waveform-shaping the pulse signal Vs2 generated by the signal generator SG near the top dead center position of one cylinder of the engine is provided to the microprocessor (generation timing of every other pulse signal P2 among a series of pulse signals P2, P2, . . . ) is the determination timing, and a time period between the last determination timing and this determination timing is one determination time period Td. The determination time period (time) Td corresponds to the measurement section (a certain rotational angle) θd, and decreases with increase in rotational speed of the engine.

The ignition power supply portion is comprised so that the number of times of the ignition power supply portion generating the capacitor charging voltage during the determination time period Td is different from the number of times of normal ignition of the engine to be performed during each determination time period. In the embodiment, the number of times of ignition performed during each determination time period is two, while the number of times of the ignition power supply portion generating the capacitor charging voltage during each determination time period is six.

The diagnosis means 33 determines that the ignition device is normal when the number of singularities having been counted by the singularity counting means 32 at the determination timing is equal to the number of times of normal ignition of the engine performed during the determination time period Td, and determines that the capacitor charging voltage is not provided from the ignition power supply portion when the number of singularities having been counted by the singularity counting means 32 at the determination timing is zero.

The diagnosis means 33 determines that the ignition coil is not electrically connected to the ignition capacitor when the number of singularities having been counted by the singularity counting means at the determination timing is equal to the number of times of the ignition power supply portion generating the capacitor charging voltage during the determination time period Td, and determines that there is a different unexpected abnormality when the number of singularities having been counted by the singularity counting means at the determination timing is not zero and is not equal to the number of times of normal ignition performed during each determination time period nor the number of times of generation of the capacitor charging voltage during each determination time period.

Figure 6:
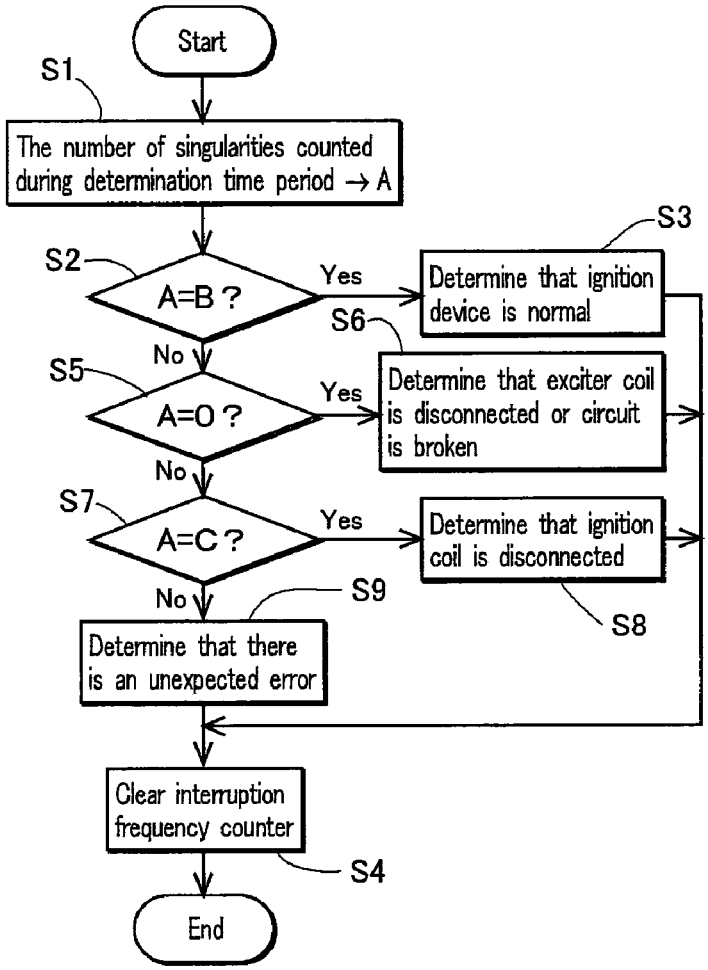
FIG. 6 is a flowchart of an example of an algorithm of a determination processing performed by the microprocessor for comprising diagnosis means in the embodiment of the FIG. 1.

FIG. 6 shows an example of a flowchart showing an algorithm of a determination processing performed by the microprocessor for each detection of the determination timing (for each generation of the pulse signal P2) for comprising the diagnosis means 33. According to the algorithm, first in Step S1, the number of singularities (the number of trailing edges of the signal Sq) counted during the determination time period Td (the time period for the crankshaft to rotate one turn) is read as A. Then, the process proceeds to Step S2, and it is determined whether the counted number of singularities A is equal to the number of times B of normal ignition performed during the determination time period. When A is equal to B, the process proceeds to Step S3, and it is determined that the ignition device is normal, then in Step S4, an interruption frequency counter (a counter for counting the number of times of detection of singularities) is cleared to reset the count value of the singularity to zero, and then the processing is finished.

When it is determined in Step S2 that A is not equal to B, it is determined that the ignition device is abnormal, the process proceeds to Step S5, and it is determined whether A is equal to zero. When it is determined that A is equal to zero, in Step S6, it is determined that the abnormality results from that the exciter coil is disconnected or the boost circuit is broken and the capacitor charging voltage is thus not provided from the ignition power supply portion. Then in Step S4, the interruption frequency counter is cleared to reset the count value of the singularity to zero, and then the processing is finished.

When it is determined in Step S5 that A is not equal to zero, the process proceeds to Step S7, and it is determined whether the count value A of the singularity is equal to the number of times C of the ignition power supply portion generating the capacitor charging voltage during the determination time period. When it is determined that A is equal to C, the process proceeds to Step S8, it is determined that the abnormality results from that the ignition coil is disconnected or the like and the ignition coil and the ignition capacitor are not electrically normally connected, and the charging circuit of the ignition capacitor is thus not established. Then in Step S4, the interruption frequency counter (the counter for counting the number of times of detection of singularities) is cleared to reset the count value of the singularity to zero, and then the processing is finished.

When it is determined in Step S7 that A is not equal to C, the process proceeds to Step S9, and it is determined that there is a different unexpected abnormality. Then in Step S4, the interruption frequency counter is cleared to reset the count value of the singularity to zero, and then the processing is finished.

The result of determination by the diagnosis means is stored by the determination result storage means 34. The determination result stored by the determination result storage means 34 can be read to check whether the ignition device is normal or abnormal, and check a cause of an abnormality if it occurs.

In the embodiment, the ignition power supply portion is comprised of the exciter coil EX, the boost circuit 6, and the diode 7. When the ignition power supply portion is thus comprised, there is no need for the exciter coil to generate a high voltage, and thus a small exciter coil with a small number of turns can be used, thereby reducing costs. Space occupied by the exciter coil in the magneto generator is reduced, thereby preventing the exciter coil from sacrificing space for a different magneto coil.

Figure 8:
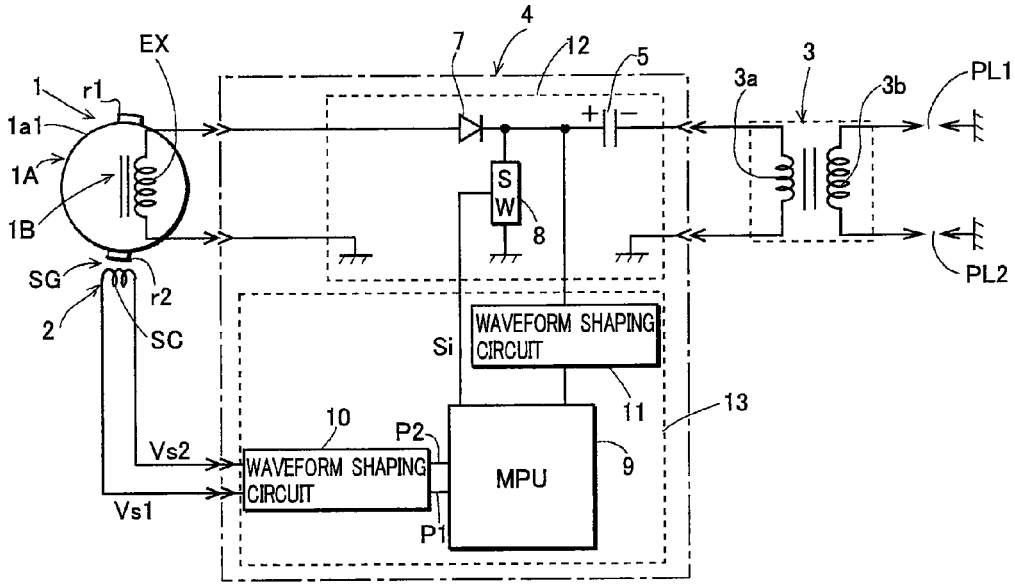
FIG. 8 is a schematic circuit diagram of an exemplary construction of hardware according to a second embodiment of the present invention.

However, the present invention is not limited to the above described construction of the ignition power supply portion. The ignition power supply portion needs only generate a capacitor charging voltage of a pulse waveform, and thus it may be allowed that the boost circuit is omitted, and as shown in FIG. 8, an ignition power supply portion is comprised of an exciter coil EX that can generate a high voltage required for charging an ignition capacitor 5 (a voltage of two hundred and several ten volts) and a diode 7. Other constructions of the ignition device in FIG. 8 are the same as in FIG. 1.

When comprised as in FIG. 8, a voltage of a half wave having one polarity of an AC voltage generated by the exciter coil is applied, as a capacitor charging voltage, across a series circuit of the ignition capacitor 5 and a primary coil of an ignition coil.

Figure 9:
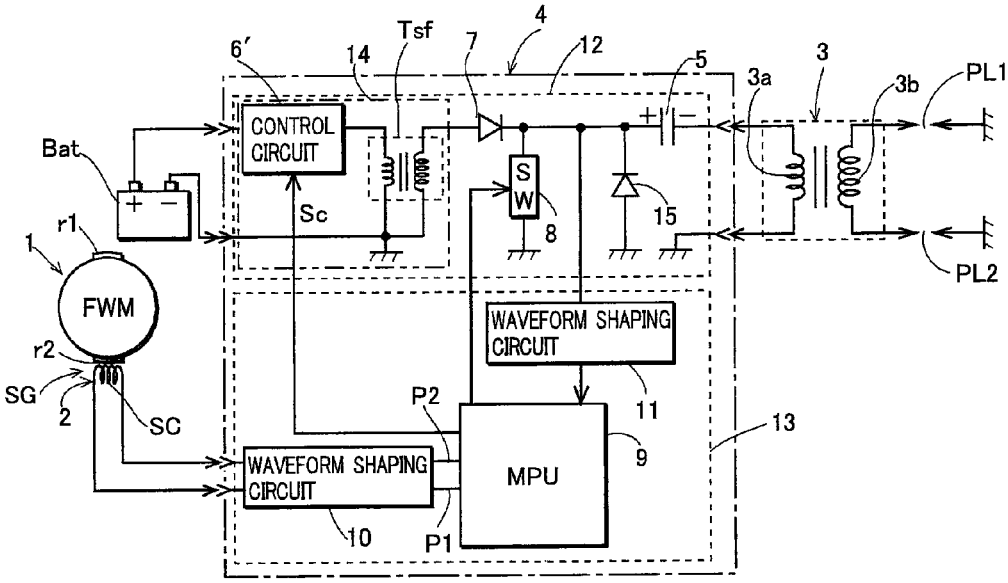
FIG. 9 is a schematic circuit diagram of an exemplary construction of hardware according to a third embodiment of the present invention.

As shown in FIG. 9, the present invention may be applied to the case where an ignition power supply portion is comprised of a battery Bat, a DC converter 14 that increases a voltage of the battery Bat, and a diode 7. The DC converter 14 in FIG. 9 includes a boost transformer Tsf, and a control circuit 6' that performs control to interrupt a primary current supplied from the battery to a primary coil of the boost transformer Tsf, and interrupts the primary current of the boost transformer Tsf to repeatedly generate a capacitor charging voltage V0 of a pulse waveform as shown in FIG. 11B while receiving a charging command signal Sc from a microprocessor 9. When an ignition device is normal, an ignition capacitor 5 is charged with the capacitor charging voltage as shown in FIG. 10B.

In the example in FIG. 9, a diode 15 is connected in anti-parallel with a discharge switch 8 for increasing a discharge time of an ignition capacitor. Other constructions are the same as in the example in FIG. 1.

Also in the ignition device in FIG. 9, when the ignition device is normal, the ignition capacitor is charged with the capacitor charging voltage supplied from the ignition power supply portion, and thus a voltage Vc between output terminals of the ignition power supply portion has a waveform as shown in FIG. 10B. At this time, the number of singularities counted during a determination time period is equal to the number of times of normal ignition performed during the determination time period. Thus, as in the embodiment in FIG. 1, the number of singularities counted during the determination time period is compared with the number of times of normal ignition performed during the determination time period to determine whether the ignition device is normal.

In the ignition device in FIG. 9, when the primary coil of the ignition coil is not electrically normally connected to the ignition capacitor and a charging circuit of the ignition capacitor is thus not established, the ignition capacitor is not charged, and a voltage detected through a waveform shaping circuit 11 is a voltage V0 generated by the DC converter 14 as shown in FIG. 11B. At this time, as shown in FIG. 1D, a signal Sq output through the waveform shaping circuit 11 changes its level at a leading edge and a trailing edge of the capacitor charging voltage V0 to detect singularities. In this case, the number of generation of the capacitor charging voltage V0 during one determination time period (during one measurement section) changes according to the circuit constant of the DC converter, and thus the number of singularities counted during the determination time period is not constant.

When the battery Bat is disconnected or the DC converter 14 is broken, and the capacitor charging voltage is not provided from the ignition power supply portion, as shown in FIG. 12B, the ignition capacitor is not charged, and no singularity is detected, and thus the number of singularities counted during the determination time period is zero.

As described above, in the case where the ignition power supply portion is comprised of the battery and the DC converter, when the ignition coil is not electrically normally connected to the ignition capacitor and the ignition capacitor is thus not charged, the number of times of generation of the capacitor charging voltage detected through the waveform shaping circuit 11 during the determination time period is not constant, and thus it cannot be properly determined whether a cause of an occurring abnormality is that the charging circuit of the ignition capacitor is not established or there is a different abnormality, by comparing the count value of the singularity counted during the determination time period with the number of times of generation of the capacitor charging voltage during the determination time period.

Thus, in this case, diagnosis means is comprised so as to determine that the ignition device is normal when the number of singularities counted by the singularity counting means during the determination time period (while the crankshaft rotates through the measurement section) is equal to the number of times of normal ignition of the engine performed during the determination time period, determine that the capacitor charging voltage is not provided from the ignition power supply portion when the number of singularities counted by the singularity counting means during the determination time period is zero, and determine that the ignition coil is not electrically normally connected to the ignition capacitor and the charging circuit of the ignition capacitor is thus not established when the number of singularities counted by the singularity counting means during the determination time period is not equal to the number of times of normal ignition of the engine performed while the crankshaft rotates through the measurement section and is not zero.

FIG. 13 is a flowchart of an algorithm of a processing performed by a microprocessor for each detection of determination timing for comprising the diagnosis means in the embodiment in FIG. 9. According to the algorithm, first in Step S101, the number of singularities (the number of trailing edges of a signal Sq) counted during a determination time period Td (a time period for a crankshaft to rotate one turn) is read as A. Then, the process proceeds to Step S102, and it is determined whether the counted number of singularities A is equal to the number of times of normal ignition B performed during the determination time period. When A is equal to B, the process proceeds to Step S103, and it is determined that the ignition device is normal. Then in Step S104, an interruption frequency counter is cleared to reset the count value of the singularity to zero, and then the processing is finished.

When it is determined in Step S102 that A is not equal to B, it is determined that the ignition device is abnormal, the process proceeds to Step S105, and it is determined whether A is equal to zero. When it is determined that A is equal to zero, in Step S106, the abnormality results from that an exciter coil is disconnected or a circuit of the DC converter 14 is broken and the capacitor charging voltage is thus not provided from the ignition power supply portion. Then in Step S104, the interruption frequency counter is cleared to reset the count value of the singularity to zero, and then the processing is finished.

When it is determined in Step S105 that A is not equal to zero, the process proceeds to Step S107, and it is determined that the abnormality results from that the ignition coil is disconnected or the like and the ignition coil and the ignition capacitor are thus not electrically normally connected. Then in Step S104, the interruption frequency counter is cleared to reset the count value of the singularity to zero, and then the processing is finished.

In the embodiment in FIG. 9, the processing for counting the singularities is the same as that in FIG. 7.

Also in the embodiment in FIGS. 1 and 8, a diode similar to the diode 15 in the embodiment in FIG. 9 may be connected in anti-parallel with the discharge switch 8.

In the embodiment, the abnormality diagnosis of the ignition device is performed by the microprocessor that controls the ignition position, but the determination processing for comprising the diagnosis means may be performed by a different microprocessor.

Figure 14:
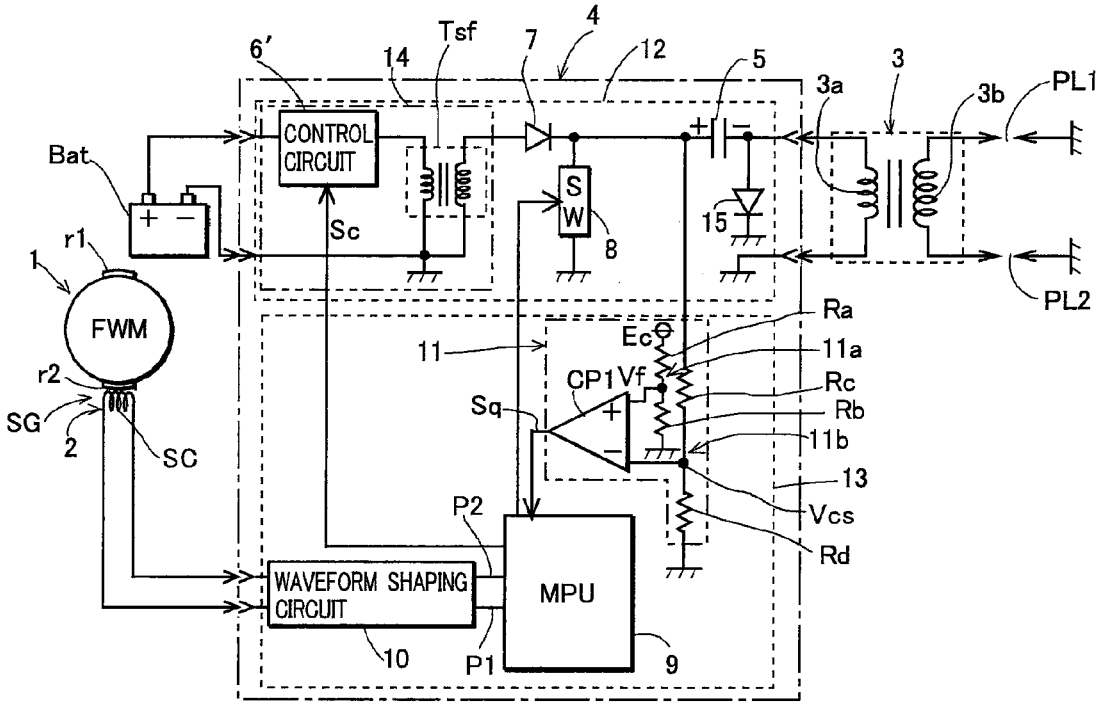
FIG. 14 is a schematic circuit diagram of an exemplary construction of hardware according to a fourth embodiment of the present invention.

In the embodiment in FIG. 9, the diode 15 is connected in anti-parallel with the discharge switch 8 comprised of a thyristor or the like, but when a voltage detection circuit 11*h* comprised of a series circuit of resistances Rc and Rd is provided in the waveform shaping circuit 11, the present invention may be applied to the case where a diode 15 having an anode directed to the other end (a non-ground terminal) of a primary coil 3*a* of an ignition coil 3 is connected in parallel across the primary coil 3*a* as shown in FIG. 14 so that an ignition plug performs DC discharge.

In the capacitor discharge ignition device in FIG. 14, when an ignition power supply portion is normal and the primary coil 3*a* of the ignition coil 3 is normally connected to an ignition circuit, a voltage Vc across a series circuit of an ignition capacitor 5 and the primary coil 3*a* (a voltage between output terminals of the ignition power supply portion) gradually increases as shown in FIG. 10B. On the other hand, in the case where the primary coil 3*a* of the ignition coil 3 is disconnected from the ignition circuit 12 (or the primary coil 3*a* is broken), once the ignition capacitor 5 is charged with an output voltage V0 of the ignition power supply portion to a peak value of the output voltage of the ignition power supply portion through the diode 15, the voltage across the ignition capacitor 5 is reversely applied across the diode 15 through the resistances Rc and Rd, which is a state equal to the state without the diode 15, and the ignition capacitor 5 is not charged. Thus, the voltage detected through the voltage detection circuit 11*b* has the same waveform as in FIG. 11B. Thus, as shown in FIG. 14, also when the diode 15 is connected in parallel across the primary coil of the ignition coil, an abnormality of the ignition device can be diagnosed as described on the embodiment in FIG. 9.

Similarly, in the embodiment in FIG. 1, a diode having a cathode directed to the ground can be connected in parallel across the primary coil 3*a* of the ignition coil.

In the above described embodiments, the waveform shaping circuit 11 is comprised of the comparator CP1, the reference voltage generation circuit 11*a*, and the voltage detection circuit 11*b*. However, the waveform shaping circuit 11 is not limited to that in the embodiments, and may be a circuit that changes a voltage Vc (or V0) between output terminals of an ignition power supply portion into a signal that changes its level to a high level (or a low level) at a trailing edge thereof and to a low level (or a high level) at a leading edge thereof (a signal suitable for a microprocessor to recognize the trailing edge or the leading edge of the voltage between the output terminals of the ignition power supply portion).

Although the preferred embodiments of the invention have been described and illustrated with reference to the accompanying drawings, it will be understood by those skilled in the art that these are by way of examples, and that various changes and modifications may be made without departing from the spirit and scope of the invention, which is defined only to the appended claims.

What is claimed is:

1. A diagnosis device of a capacitor discharge ignition device for an engine that diagnoses the capacitor discharge ignition device for an engine comprising: an ignition power supply portion that repeatedly outputs a capacitor charging voltage of a pulse waveform; an ignition coil; an ignition capacitor connected in series with a primary coil of said ignition coil and charged with an output voltage of said ignition power supply portion through said primary coil; a discharge switch that conducts when receiving an ignition signal and discharges charges accumulated in said ignition capacitor through the primary coil of said ignition coil; and an ignition position control portion that provides an ignition signal to said discharge switch at an ignition position of the engine, said capacitor discharge ignition device for an engine inducing a high voltage for ignition in a secondary coil of said ignition coil by the discharge of the charges accumulated in said ignition capacitor, wherein said diagnosis device comprising:

singularity detection means for detecting, as a singularity, a leading edge or a trailing edge of a voltage between output terminals of said ignition power supply portion;

singularity counting means for counting the number of singularities detected by said singularity detection means while a crankshaft rotates through a measurement section, which is a section of a certain crank angle determined with reference to a pulse signal obtained by a signal generator that generates a pulse signal at a specific crank angle position of said engine; and diagnosis means for diagnosing an abnormality of said ignition device and a cause of the abnormality by comparing the number of singularities counted by said singularity counting means with the number of times of normal ignition of the engine performed while said crankshaft rotates through said measurement section.

2. The diagnosis device of a capacitor discharge ignition device for an engine according to claim 1, wherein said diagnosis means is comprised so as to determine that said ignition device is normal when the number of singularities counted by said singularity counting means is equal to the number of times of normal ignition of said engine performed while said crankshaft rotates through said measurement section, determine that said capacitor charging voltage is not provided from said ignition power supply portion when the number of singularities counted by said singularity counting means is zero, and determine that said ignition coil is not electrically normally connected to said ignition capacitor and a charging circuit of said ignition capacitor is thus not established when the number of singularities counted by said singularity counting means is not equal to the number of times of normal ignition of said engine performed while said crankshaft rotates through said measurement section and is not zero.

3. The diagnosis device of a capacitor discharge ignition device for an engine according to claim 2, wherein said ignition power supply portion is comprised of a battery and a DC converter that increases an output voltage of said battery, and a state where said capacitor charging voltage is not provided from said ignition power supply portion is a state where said battery is disconnected or said DC converter is broken.

4. The diagnosis device of a capacitor discharge ignition device for an engine according to claim 2, wherein said ignition power supply portion comprises an exciter coil that is provided in a magneto generator driven by said engine and generates an AC voltage in synchronization with rotation of said engine, and a rectifier circuit that half-wave or full-wave rectifies the output voltage of said exciter coil and provides the voltage across a series circuit of said ignition capacitor and the primary coil of the ignition coil, and the state where said capacitor charging voltage is not provided from said ignition power supply portion is a state where said exciter coil is disconnected or a state where said rectifier circuit is broken.

5. The diagnosis device of a capacitor discharge ignition device for an engine according to claim 2, wherein said ignition power supply portion comprises an exciter coil that is provided in a magneto generator driven by said engine and generates an AC voltage in synchronization with rotation of said engine, and a boost circuit that passes a short-circuit current through said exciter coil when a voltage of a half wave having one polarity is induced in said exciter coil, and interrupts said short-circuit current to induce an increased pulse voltage in said exciter coil when the short-circuit current becomes a set value or more, and the state where said capacitor charging voltage is not provided from said ignition power supply portion is a state where said exciter coil is disconnected or a state where said boost circuit is broken.

6. The diagnosis device of a capacitor discharge ignition device for an engine according to claim 2, wherein said ignition power supply portion is comprised so that the number of times of said ignition power supply portion generating the capacitor charging voltage while said crankshaft rotates through said measurement section is different from the number of times of normal ignition of said engine to be performed while said crankshaft rotates through said measurement section, and said diagnosis means is comprised so as to determine that said ignition device is normal when the number of singularities counted by said singularity counting means is equal to the number of times of normal ignition of said engine performed while said crankshaft rotates through said measurement section, determine that said ignition coil is not electrically normally connected to said ignition capacitor and the charging circuit of said ignition capacitor is thus not established when the number of singularities counted by said singularity counting means is equal to the number of times of said ignition power supply portion generating said capacitor charging voltage while said crankshaft rotates through said measurement section, determine that said capacitor charging voltage is not provided from said ignition power supply portion when the number of singularities counted while said crankshaft rotates through said measurement section is zero, and determine that there is a different unexpected abnormality when the number of singularities counted by said singularity counting means is not zero and is not equal to the number of times of normal ignition performed while said crankshaft rotates through said measurement section nor equal to the number of times of said ignition power supply portion generating the capacitor charging voltage while said crankshaft rotates through said measurement section.

7. A diagnosis device of a capacitor discharge ignition device for an engine that diagnoses the capacitor discharge ignition device for an engine comprising: an ignition power supply portion that repeatedly outputs a capacitor charging voltage of a pulse waveform; an ignition coil; an ignition capacitor connected in series with a primary coil of said ignition coil and charged with an output voltage of said ignition power supply portion through said primary coil; a discharge switch that conducts when receiving an ignition signal and discharges charges accumulated in said ignition capacitor through the primary coil of said ignition coil; and an ignition position control portion that provides an ignition signal to said discharge switch at an ignition position of the engine, said capacitor discharge ignition device for an engine inducing a high voltage for ignition in a secondary coil of said ignition coil by the discharge of the charges accumulated in said ignition capacitor, wherein said diagnosis device comprising:

singularity detection means for detecting, as a singularity, a leading edge or a trailing edge of a voltage between output terminals of said ignition power supply portion;

singularity counting means for incrementing a count value for each detection of the singularity by said singularity detection means and storing the count value as the number of singularities;

diagnosis means for diagnosing an abnormality of the ignition device and a cause of the abnormality from the number of singularities having been counted by said singularity counting means when determination timing is detected that is determined based on a pulse signal obtained by a signal generator that generates a pulse signal at a specific crank angle position of said engine; and memory contents reset means for clearing memory contents of said singularity counting means when said diagnosis means completes the diagnosis, wherein said ignition power supply portion is comprised so that when a time period between the last determination timing and this determination timing is one determination time period, the number of times of said ignition power supply portion generating the capacitor charging voltage during each determination time period is different from the number of times of normal ignition of said engine to be performed during each determination time period, and said diagnosis means is comprised so as to determine that said ignition device is normal when the number of singularities having been counted by said singularity counting means at said determination timing is equal to the number of times of normal ignition of the engine performed during said determination time period, determine that said capacitor charging voltage is not provided from said ignition power supply portion when the number of singularities counted by said singularity counting means at said determination timing is zero, determine that said ignition coil is not electrically normally connected to said ignition capacitor and a charging circuit of said ignition capacitor is thus not established when the number of singularities having been counted by said singularity counting means at said determination timing is equal to the number of times of said ignition power supply portion generating the capacitor charging voltage during said determination time period; and determine that there is a different unexpected abnormality when the number of singularities having been counted by said singularity counting means at said determination timing is not zero and is not equal to the number of times of normal ignition performed during each determination time period nor equal to the number of times of generation of said capacitor charging voltage during each determination time period.

8. The diagnosis device of a capacitor discharge ignition device for an engine according to claim 7, wherein said ignition power supply portion is comprised of a battery and a DC converter that increases an output voltage of said battery, and a state where said capacitor charging voltage is not provided from said ignition power supply portion is a state where said battery is disconnected or said DC converter is broken.

9. The diagnosis device of a capacitor discharge ignition device for an engine according to claim 7, wherein said ignition power supply portion comprises an exciter coil that is provided in a magneto generator driven by said engine and generates an AC voltage in synchronization with rotation of said engine, and a rectifier circuit that half-wave or full-wave rectifies the output voltage of said exciter coil and provides the voltage across a series circuit of said ignition capacitor and the primary coil of the ignition coil, and the state where said capacitor charging voltage is not provided from said ignition power supply portion is a state where said exciter coil is disconnected or a state where said rectifier circuit is broken.

10. The diagnosis device of a capacitor discharge ignition device for an engine according to claim 7, wherein said ignition power supply portion comprises an exciter coil that is provided in a magneto generator driven by said engine and generates an AC voltage in synchronization with rotation of said engine, and a boost circuit that passes a short-circuit current through said exciter coil when a voltage of a half wave having one polarity is induced in said exciter coil, and interrupts said short-circuit current to induce an increased pulse voltage in said exciter coil when the short-circuit current becomes a set value or more, and the state where said capacitor charging voltage is not provided from said ignition power supply portion is a state where said exciter coil is disconnected or a state where said boost circuit is broken.

11. A diagnosis device of a capacitor discharge ignition device for an engine that diagnoses the capacitor discharge ignition device for an engine comprising: an ignition power supply portion that repeatedly outputs a capacitor charging voltage of a pulse waveform; an ignition coil; an ignition capacitor connected in series with a primary coil of said ignition coil and charged with an output voltage of said ignition power supply portion through said primary coil; a discharge switch that conducts when receiving an ignition signal and discharges charges accumulated in said ignition capacitor through the primary coil of said ignition coil; and an ignition position control portion that provides an ignition signal to said discharge switch at an ignition position of the engine, said capacitor discharge ignition device for an engine inducing a high voltage for ignition in a secondary coil of said ignition coil by the discharge of the charges accumulated in said ignition capacitor, wherein said diagnosis device comprising:

singularity detection means for detecting, as a singularity, a leading edge or a trailing edge of a voltage between output terminals of said ignition power supply portion;

singularity counting means for incrementing a count value for each detection of the singularity by said singularity detection means and storing the count value as the number of singularities;

diagnosis means for diagnosing an abnormality of the ignition device and a cause of the abnormality from the number of singularities having been counted by said singularity counting means when determination timing is detected that is determined based on a pulse signal obtained by a signal generator that generates a pulse signal at a specific crank angle position of said engine; and memory contents reset means for clearing memory contents of said singularity counting means when said diagnosis means completes the diagnosis, wherein said ignition power supply portion is comprised of a battery and a DC converter that increases an output voltage of said battery, and said diagnosis means is comprised so as to determine that said ignition device is normal when the number of singularities having been counted by said singularity counting means at said determination timing is equal to the number of times of normal ignition of said engine to be performed between the last determination timing and this determination timing, determine that said ignition coil is not electrically normally connected to said ignition capacitor and a charging circuit of said ignition capacitor is thus not established when the number of singularities having been counted by said singularity counting means at said determination timing is not equal to the number of times of normal ignition of said engine to be performed between the last determination timing and this determination timing, and determine that said battery is disconnected or said DC converter is broken when the number of singularities having been counted by said singularity counting means at said determination timing is zero.

* * * * *

UNITED STATES PATENT AND TRADEMARK OFFICE

CERTIFICATE OF CORRECTION

PATENT NO. : 7,688,073 B2
APPLICATION NO. : 12/026566
DATED : March 30, 2010
INVENTOR(S) : Mitsuyoshi Shimazaki et al.

It is certified that error appears in the above-identified patent and that said Letters Patent is hereby corrected as shown below:

Column 18, line 7, please delete "1D" and insert therefor --11D--

Signed and Sealed this
First Day of March, 2011

David J. Kappos

David J. Kappos
*Director of the United States Patent and Trademark Office*